United States Patent [19]

Prince et al.

[11] 3,951,842

[45] Apr. 20, 1976

[54] SYNTHETIC DETERGENT BAR WITH ANTIMUSHING AGENT

[75] Inventors: Leon M. Prince, Westfield; Joseph P. Furrier, Northvale, both of N.J.

[73] Assignee: Lever Brothers Company, New York, N.Y.

[22] Filed: Apr. 2, 1973

[21] Appl. No.: 347,105

[52] U.S. Cl. ..... 252/117; 252/121; 252/134; 252/DIG. 16

[51] Int. Cl.[2] ..... C11D 9/32; C11D 9/30; C11D 9/48

[58] Field of Search ..... 252/117, 121, 134, 107, 252/DIG. 16

[56] References Cited

UNITED STATES PATENTS

| | | | |
|---|---|---|---|
| 2,894,912 | 7/1959 | Geitz | 252/121 |
| 3,043,778 | 7/1962 | Kelly | 252/107 |
| 3,076,766 | 2/1963 | Arstett | 252/117 |
| 3,376,229 | 4/1968 | Haass et al. | 252/121 X |
| 3,654,167 | 4/1972 | Akrongold et al. | 252/134 X |

FOREIGN PATENTS OR APPLICATIONS

| | | | |
|---|---|---|---|
| 945,062 | 12/1963 | United Kingdom | 252/DIG. 16 |

*Primary Examiner*—Benjamin R. Padgett
*Assistant Examiner*—Edward A. Miller
*Attorney, Agent, or Firm*—James J. Farrell

[57] ABSTRACT

Toilet detergent bars having the property of softening in the soap dish to form a slimy, gel-like, mushy hydrate, and containing about 30 to about 60 percent sodium acyl isethionate detergent are made firmer and the tendency to form a mushy hydrate is decreased, and the rate of drying of the hydrate is increased, if there is incorporated in the bar a dimerized linoleic acid, or a mixture of sodium sulfate and sodium chloride.

6 Claims, No Drawings

SYNTHETIC DETERGENT BAR WITH ANTIMUSHING AGENT

BACKGROUND OF THE INVENTION

1. Field of the Invention

The present invention is concerned with the presence of certain agents in a toilet detergent tablet having an acyl isethionate as the predominant surface active detergent, to lessen the tendency of the tablet to form mush in the holder.

It is well known that toilet tablets, both those based on soap and on nonsoap synthetic detergents, absorb water, or hydrate, when left wet in the conventional holder, or dish, after using. The hydrate is soft, and this condition may exist not only on the surface but for some distance below the surface. The hydrate falls from the tablet, or is removed during the next usage, depending upon the degree of softness. This softening and removal is variously referred to as sliming, sloughing, melting, slushing, smearing, slopping, mushing, etc.

Various additives have been incorporated in soap and detergent tablets to ameliorate mushing tendencies, as set forth elsewhere herein. However, it is believed that the anti-mushing agents of the present invention have particular adaptability to nonsoap detergent toilet tablets wherein an acyl isethionate is the predominant surface-active agent.

2. The Prior Art

The most pertinent art known to applicant is set forth below.

A lithium salt of the linoleic dimer acid is disclosed as a lubricant component in U.S. Pat. No. 2,983,680. U.S. Pat. No. 3,267,038 discloses linoleic dimer acid and related polymeric acids as corrosion inhibitors in detergent compositions containing a polyphosphate. U.S. Pat. No. 3,538,009 discloses the use of linoleic dimer acid and related polymeric acids in detergent compositions to reduce skin irritation.

Sodium sulfate is a by-product formed in the manufacture of substantially all sulfate and sulfonate detergents. Representative patents disclosing or suggesting the presence of sodium sulfate in detergent tablets are U.S. Pat. Nos. 2,846,398, 3,055,837, and 3,383,320.

The use of sodium chloride, both with and without sodium sulfate, is known in toilet tablets as disclosed in the following representative patents.

Mixtures of potassium sulfate and potassium chloride in a nonsoap aerated tablet are shown in U.S. Pat. No. 2,407,647. In this patent there is disclosed a nonsoap aerated tablet having 1.5 to 10.5 percent total $K_2SO_4$ and KCl in the ratio 1:2.

U.S. Pat. No. 2,356,903 discloses a nonsoap tablet containing 5 to 40 percent of finely divided NaCl or KCl. It is disclosed in this patent that powdered sodium sulfate increases the tendency of the tablet to become smeary on the washstand, and that sodium sulfate or sodium chloride decreases this tendency.

U.S. Pat. No. 2,686,761 discloses milled soap having 35–40 percent water and 1–12 percent sodium chloride.

Mixtures of sodium sulfate and sodium chloride in a detergent having a liquid and a particulate form are disclosed in the ratio of 5.38 and 0.83 in U.S. Pat. No. 2,744,874. Sodium sulfate and sodium chloride at a combined level of 1 to 5 percent and a ratio of 4.87 to 0.20, tablet basis, are disclosed in U.S. Pat. No. 2,991,253.

U.S. Pat. No. 3,055,837 discloses that sodium chloride may be present as a filler in a detergent tablet and U.S. Pat. No. 3,070,547 discloses that the presence of alkali-metal chlorides in a soap-synthetic tablet reduces smear or slushiness thereof, and further discloses that the effectiveness of the alkali-metal sulfates in this respect is only about one-half that of the chlorides.

U.S. Pat. No. 3,223,645 discloses 2–16 percent of a mixture of sodium chloride and potassium chloride in a soap tablet.

U.S. Pat. No. 3,247,121 discloses a soap-synthetic tablet with 0–85 percent synthetic detergent; 0.5–30 percent alpha-sulfo soap to lessen smear; 0–15 percent free fatty acids; 2–12 percent inorganic salts to firm the tablet and to aid in preventing undesirable smear without unacceptable surface crystallization; and 0–15 percent water.

U.S. Pat. No. 3,376,229 relates to the use of a firming agent in a synthetic detergent tablet based mainly on acyl isethionates, the firming agent being unesterified alkali-metal salts of isethionic acid, employed in amounts in excess of that associated with the acyl isethionate detergent.

U.S. Pat. No. 3,576,749 teaches that 1–3 percent sodium chloride provides acceptable smear characteristics when incorporated in a soap tablet free from nonsoap detergents.

South African application No. 63/3067 discloses a synthetic detergent tablet containing from about 46 to about 88 percent of inorganic alkaline and neutral salts, among which are sulfates and chlorides.

The procedures for preparing alkali metal acyl isethionates are well known to those skilled in the art. The reaction between isethionic acid free of its salts, and fatty acids is described in U.S. Pat. No. 3,151,136. The acid reaction product is neutralized preferably with a mixture of sodium hydroxide and sodium disilicate. U.S. Pat. No. 3,320,292 discloses the use of a basic zinc compound as a catalyst in the preparation of an acyl isethionate from a fatty acid and sodium isethionate, while U.S. Pat. No. 3,383,396 discloses the use of a zirconium compound in the same preparation. U.S. Pat. No. 3,376,229 describes the use of about 4 to 7 percent free sodium isethionate to harden a detergent bar having a composition in accordance with the instant invention, except for the anti-mushing additives. The basic bar composition is described in U.S. Patent No. 2,894,912. U.S. Pat. Nos. 3,420,857 and 3,420,858 disclose processes for controlling the distribution of the several chain-length fatty acids used in the admixture in the preparation of acyl isethionates. U.S. Pat. No. 3,429,136 discloses a step of flash-cooling acyl isethionates after preparation.

SUMMARY OF THE INVENTION

It has now been discovered that the mushing tendencies of a toilet detergent tablet containing about 30 to about 60 percent of a sodium acyl isethionate can be greatly reduced by the incorporation of relatively low proportions of an anti-mushing agent selected from the group consisting of linoleic dimer acid and mixtures of sodium sulfate and sodium chloride within the ratios of about 3:2 to about 2:3, or mixtures of these agents.

Soaps in tablet form are subject to mushing, but to a lesser degree than are the nonsoaps, and moreover the soaps lose water picked up during use more rapidly than the nonsoaps, and recover their firmness sooner. The mixture of sodium sulfate and sodium chloride in the predominantly nonsoap bars of the present invention shifts the rate of firmness recovery toward the more rapid rate of recovery inherent in soap tablets.

The present invention is particularly useful under conditions wherein the detergent tablets are re-used after only about a 10-minute to about a 3-hour drying period under normal household conditions.

The present invention is applicable to toilet detergent tablets of the type disclosed and claimed in U.S. Pat. No. 2,894,912, assigned to the instant assignee, and incorporated herein by reference. The aforementioned tablets consist essentially of about 30 to about 70 percent of water-soluble alkali metal detergent salts of esters of isethionic acid with mixed aliphatic fatty acids having from 6 to 18 carbon atoms and an iodine value of less than 20, of which mixed acids at least 75 percent have from twelve to eighteen carbon atoms and up to 25 percent have from six to ten carbon atoms, from 2 to 10 percent of at least one water-soluble suds-boosting detergent salt selected from the group consisting of alkali metal and organic amine higher aliphatic fatty alcohol sulfates, alkyl aryl sulfonates, and the higher aliphatic fatty acid taurides, from about 1 to about 9 percent water, from about 2.5 to about 25 percent of water-soluble higher fatty acid soap, and from 10 to 40 percent of at least one higher fatty acid having from about 12 or about 25 carbon atoms as a binder and plasticizer, said bar having a pH within the range from 6 to 8, measured as a 10 percent aqueous solution of the bar composition at 35°C.

Sodium chloride tends to "shorten" the tablet, that is, to make the tablet less plastic and decreases mushing without efflorescing, but does not make the tablet longer lasting. As the proportion of sodium chloride is increased, the detergent mass becomes increasingly harder in the absence of sodium sulfate, until at about the 5 percent level in the tablets of the present invention, the plasticity is adversely affected and the wear rate is not improved. At about the 10 percent level of sodium chloride and above, the mass is too hard to process in the tablet-making equipment.

On the other hand, $Na_2SO_4$ decreases the rate of wear of isethionate tablets, and hastens the drying rate after immersion in water, but causes efflorescence at about the 10 percent level and above. $Na_2SO_4$ also hardens the tablet, but to a much lesser degree than does NaCl.

As may be noted from the foregoing, neither sodium sulfate nor sodium chloride alone is entirely satisfactory. However, it has been discovered that the shortening effect of sodium chloride is ameliorated by the presence of sodium sulfate, thus making it possible to employ, in the presence of sodium sulfate, sufficient sodium chloride to obtain decreased mushing and increased hardness, and to use a combination of sodium chloride and sodium sulfate wherein the latter need not be in sufficiently high proportion to cause efflorescence. Thus the combination of sodium sulfate and sodium chloride within the weight ratios of 3:2 to 2:3 possesses properties in an acyl isethionate-based tablet not observed through the use of either of these salts alone, e.g., the combination imparts a decreased wear rate, and does not cause efflorescence.

The inclusion of inorganic salts such as a mixture of 5 percent $Na_2SO_4$ and 5 percent NaCl must necessarily lower the proportion of active lathering ingredients with the possibility of decreased lather. For this reason the level of anti-mush agent will be maintained as low as possible in order that the active lathering ingredients may be kept at an adequately high level. The percentage of the linoleic acid dimer may range from about 3 to about 10 percent, while the percentage of $Na_2SO_4$ and NaCl taken together may range from about 5 to about 20 percent, the levels of each ranging from about 2.5 to about 10 percent, and the ratios being within the range of about 2:3 to about 3:2. All three agents may be employed together, in which case the stated ratio of sulfate to chloride will be maintained, and the total of the three agents will range from about 3 to about 25 percent. Especially useful are combinations of sodium sulfate and sodium chloride, each in the proportions of about 5 to about 7.5 percent whole composition basis.

A desirable tablet is obtained when the anti-mushing agent comprises about 4 percent by weight of sodium sulfate, about 3 percent by weight of sodium chloride, and about 3 percent by weight of linoleic and dimer.

It is therefore an object of the present invention to provide a toilet detergent tablet having a reduced tendency to form mush in the dish, and to provide an increased rate of loss of water of hydration absorbed on the bar during use.

It is a further object of the invention to provide a detergent toilet tablet having an improved rate of wear, i.e., longer lasting, in use as compared with a tablet of the same composition but without the incorporation of an anti-mushing agent.

The present invention in its broadest aspect relates to a toilet detergent tablet having therein about 30 to about 60 percent of a sodium acyl isethionate having a molecular weight in the detergent range and containing an anti-mushing agent selected from the group consisting of dimerized linoleic acid, and mixtures of sodium sulfate and sodium chloride within the ratios of about 3:2 to 2:3, and mixtures of said agents.

In another aspect the invention relates to a process for lessening the mushing tendencies of a toilet detergent bar having therein about 30 to about 60 percent of a sodium acyl isethionate having an acyl group of about 6 to about 18 carbon atoms, comprising incorporating into said bar an anti-mushing agent within the group described hereinabove.

In still another aspect, the invention relates to a mixture of sodium sulfate and sodium chloride in combination within the weight ratios of about 3:2 to 2:3, in a detergent toilet tablet based on a mixture of detergent substances wherein an alkali-metal acyl isethionate constitutes a major proportion of said detergent substances. The term "detergent substances" in the foregoing context includes soap, as well as fatty alcohol sulfates, alkyl aryl sulfonates, and the higher aliphatic fatty acid taurides, defined hereinafter.

Accordingly the invention provides a toilet detergent tablet comprising from about 30 to about 60 percent of water-soluble alkali metal detergent salts of esters of isethionic acid with mixed aliphatic fatty acids having from six to eighteen carbon atoms and an iodine value of less than 20, of which mixed acids at least 75 percent have from 12 to 18 carbon atoms and up to 25 percent have from 6 to 10 carbon atoms, from 2 to 10 percent of at least one water-soluble suds-boosting detergent salt selected from the group consisting of alkali metal and organic amine higher aliphatic fatty alcohol sulfates, alkyl aryl sulfonates, and the higher aliphatic fatty acid taurides, from about 1 to about 9 percent water, from about 2.5 to about 25 percent of water-soluble higher fatty acid soap, and from 10 to 40 percent of at least one higher fatty acid having from about 12 to about 25 carbon atoms as a binder and plasticizer, and an anti-mushing agent in the proportions of about 3 to about 20 percent, said tablet having improved hardness and firmness recovery characteristics, and having a pH within the range of about 6 to about 8, measured as a 10 percent aqueous solution of the bar composition at 35°C.

The invention also provides a toilet detergent tablet comprising the following components in parts by weight:

| | Parts by Weight of Tablet |
|---|---|
| a. Sodium acyl isethionate | 40–60 |
| b. Fatty acid | 15–25 |
| c. Soap of a higher fatty acid | 5–15 |
| d. Sodium isethionate | 2–5 |
| e. Sodium alkylbenzenesulfonate | 2–4 |
| f. Sodium chloride | 2.5–10 |
| g. Sodium sulfate | 2.5–10 |
| h. Water | 3–6 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22 percent has 8–14 carbon atoms, the alkyl group of said alkylbenzenesulfonate is derived from a straight-chain hydrocarbon mixture having an average of about 13 carbon atoms, the sum of (a) through (h) lies within the range of about 96 to about 100 parts by weight, the ratio of said sodium sulfate to sodium chloride lies within the range of about 3:2 to about 2:3, and the sum thereof lies within the range of about 5 to about 20 parts by weight, whole composition basis.

As a preferred embodiment, the tablets of the present invention comprise the following components in the proportions indicated on the following page.

| | Parts by Weight of Tablet |
|---|---|
| a. Sodium acyl isethionate | 44–55 |
| b. Fatty acid | 16–20 |
| c. Soap of a higher fatty acid | 9–13 |
| d. Sodium isethionate | 1.5–2 |
| e. Sodium alkylbenzenesulfonate | 1–3 |
| f. Sodium chloride | 4–8 |
| g. Sodium sulfate | 4–8 |
| h. Water | 3–6 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22 percent has 8–14 carbon atoms, the alkyl portion of said alkylbenzenesulfonate is derived from a straight-chain hydrocarbon mixture having an average of about 13 carbon atoms, the sum of (a) through (h) lies within the range of about 96 parts to about 100 parts by weight, the balance if any, consisting of minor additives, such as germicides, $TiO_2$, colorants, and miscellaneous ingredients associated with the above-named components. The ratio of said sodium sulfate to said sodium chloride lies within the range of about 3:2 to about 2:3, and the sum thereof lies within the range of about 8 to about 16 percent, whole composition basis.

Useful tablets in accordance with the invention have the following approximate composition.

| | Parts by Weight of Tablet |
|---|---|
| Sodium acyl isethionate[a] | 44–45 |
| Stearic acid | 17–19 |
| Coconut oil fatty acids | 2–3 |
| Soap of mixed tallow and coconut oil[a] | 7–8 |
| Sodium stearate | 2–3 |
| Sodium isethionate | 4–5 |
| Sodium alkylbenzenesulfonate[a] | 2–3 |
| Sodium sulfate | 5–6 |
| Sodium chloride | 5–6 |
| $TiO_2$ | 0.1–0.3 |
| Germicides | 0.7–1.5 |
| Perfume | 0.7–1.5 |
| Colorants | 0.001–0.003 |
| Miscellaneous[a] | 1.5–3 |
| Water | 4–5 |

[a]defined as in Example 2.

The invention further provides a process for lessening the mushing tendencies of a toilet detergent tablet containing an acyl isethionate in a proportion not exceeded by any other component therein, and in the proportions of about 30 to about 60 percent, comprising incorporating into said bar from about 3 to about 20 percent of an anti-mushing agent selected from the group consisting of linoleic dimer acid, and mixtures of sodium sulfate and sodium chloride within the ratios of about 3:2 to about 2:3, and mixtures of said agents, said tablet having improved hardness and firmness recovery characteristics, and being substantially free from efflorescence, and having a pH within the range of about 6 to about 8, measured as a 10 percent aqueous solution of the bar composition at 35°C.

A particular advantage accruing from the practice of this invention is the improved recovery of the tablets from the mushiness imparted during use of the bar. A test to show this advantage has been devised wherein the tablet is allowed to hydrate under exaggerated conditions, and subsequently allowed to dry in the air. Tablets of the instant invention when submitted to this test, described elsewhere herein as the Firmness Recovery Test, lose the water of hydration more rapidly, and in so doing become firmer than tablets of comparable composition which do not contain the instant anti-mush additives.

In general, a tablet with a low wear rate will tend to remain firm in the dish and have less tendency to mush than one with a high wear rate.

Thus, the anti-mushing effectiveness of the agents described and claimed herein is quantitatively determined by measuring the rate at which the tablet wears away during a standardized washing procedure, referred to as the "Wear Rate Test" whereby the weight of the tablet consumed per use is determined. The Wear Rate Test is conducted in accordance with the description below. It will be understood that the results obtained by this test may vary slightly from operator to operator and may also show variations from day to day, but that the results obtained on tablets tested as a group by the same operator may be validly compared. For this reason control tablets are tested along with the tablets of each Example herein.

WEAR RATE TEST

Material a. Smooth flat-bottomed plastic soap dishes
b. Pin rack or other point support for drying bars
c. Gallon container marked at ½ gallon.

PROCEDURE

The test begins of the morning of Day 1, and terminates on the morning of Day 3. Record the initial weight of the bar to the nearest 0.01 gram. Prepare ½ gallon of tap water at 105°F in the 1 gallon container. Submerge the hands and the bar in the 105°F water, remove both the bar and hands and rotate the bar 20 times between the hands (1 rotation = 180°). Submerge the bar and hands in the water, remove the bar and hands, and repeat the above described washing (20 rotations). Submerge the bar and hands in the water, remove the bar in the hands and place the bar in the soap dish. Repeat the above described washing 4 times during the day on Day 1 and Day 2.

Tap water at 80°F is added to the dish prior to placing the bar in the dish following the first and last wash on Day 1 and Day 2 (6½ ml of tap water for regular size, 7½ ml of tap water for bath size).

On the morning of Day 3 wash the bar as before, rinse in the wash water, and place on pin rack to dry. Dry bar at least 4 hours and weigh to nearest 0.01 gram.

CALCULATION

Calculate the weight in grams used per wash:

$$\frac{\text{Initial weight in grams} - \text{final weight in grams}}{\text{number of washes}} = \text{grams per use}$$

FIRMNESS RECOVERY TEST

Weighed tablets of the same size and shape are submerged end-wise to half their length in distilled water at room temperature for five minutes. The tablets are removed from the water, weighed, and placed on a rack designed to allow free access of air to the immersed portion. The tablets are weighed at desired intervals as they progressively dry. For purposes of comparison of the tablets one with the other, the weight of water absorbed during the five-minute immersion is taken as 100 percent. The weight of absorbed water remaining at each subsequent weighing is converted to a percentage by weight of the water initially absorbed. A comparison of the figures thus obtained provides comparative information on the rate of loss of absorbed water, which, experience has shown, correlates with the return of the wet tablet to its original firmness.

If desired, visual observations may be made at each weighing step to observe the rate at which the tablet returns to its original firmness.

The essence of the present invention is the use of the above-mentioned anti-mushing agents in detergent bars wherein sodium acyl isethionate is present in a proportion not exceeded by any other component therein.

The sodium acyl isethionate component may be prepared by methods well known to those skilled in the art. Suitable preparatory procedures may be found in U.S. Pat. Nos. 3,320,292, 3,376,229, 3,151,136, 3,383,396, 3,420,857 and 3,420,858.

The alkylbenzenesulfonates useful in the present invention may have a branched alkyl group of about 9 to about 15 carbon atoms such as may be derived from polypropylene as described in U.S. Pat. Nos. 2,477,382 and 2,477,383. Preferably the alkyl group is a straight chain having about 11 to about 15 carbon atoms and the sulfonated phenyl group is randomly positioned along the alkyl chain. Also useful are the alkylbenzenesulfonates described in U.S. Pat. Nos. 2,390,295, 3,320,174, and in U.S. Pat. Nos. 2,712,530 and 2,723,240.

The term "soap" is used herein in its popular meaning, i.e., the alkali metal salts of aliphatic alkane- or alkenemonocarboxylic acids. In general, the sodium soaps are used in the bars of the invention, but from about 1 to about 25 percent of the soap may be potassium soaps. The soaps useful herein are the well-known alkali-metal salts of natural or synthetic fatty (alkanoic or alkenoic) acids having about 12 to about 20 carbon atoms, preferably about 12 to about 18 carbon atoms, and may be described as alkali-metal carboxylates of acyclic hydrocarbons having about 12 to about 20 carbon atoms.

Soaps having the fatty acid distribution of coconut oil may provide the lower end of the broad molecular weight range, while soaps having the fatty acid distribution of peanut or rapeseed oil, or their hydrogenated derivatives, may provide the upper end of the broad molecular weight range. It is preferred to use the soaps having the fatty acid distribution of coconut oil or tallow, or mixtures thereof, since these are among the more readily available fats. The proportion of fatty acids having at least 12 carbon atoms in coconut oil soap is about 84 percent. This proportion will be greater when mixtures of coconut oil and fats such as tallow, palm oil, or non-tropical nut oils or fats are used, wherein the principal chain lengths are $C_{16}$ and higher. The preferred soap for use in the present invention then has at least 84 percent fatty acids having about 12–18 carbon atoms.

It will be understood that the coconut oil employed for the soap, and for the isethionate as well, may be substituted in whole or in part by other "high-lauric" oils, that is, oils or fats wherein at least 50 percent of the total fatty acids are composed of lauric or myristic acids or mixtures thereof. These oils are generally exemplified by the tropical nut oils of the coconut oil class, such as palm kernel oil, babassu oil, ouricuri oil, tucum oil, cohune nut oil, murumuru oil, jaboty kernel oil, khakan kernel oil, dika nut oil, and for present purposes ucuhuba butter, a vegetable triglyceride high in myristic acid esters.

A preferred soap is a mixture of about 15 to about 20 percent coconut oil and about 80 to about 85 percent tallow. These mixtures contain about 95–96 percent fatty acids having about 12 to about 18 carbon atoms. The soap may be prepared from coconut oil, in which case the fatty acid content is about 84 percent of $C_{12}$–$C_{18}$ chain length.

The soaps may contain unsaturation in accordance with the commercially acceptable standards. Excessive unsaturation is normally avoided.

The soaps may be made by the well-known kettle boiling process from natural fats and oils such as tallow or coconut oil or their equivalents, by boiling with an alkali-metal hydroxide, using procedures well known to those skilled in the art. Alternatively the soaps may be made by neutralizing fatty acids, such as lauric ($C_{12}$), myristic ($C_{14}$), palmitic ($C_{16}$), or stearic ($C_{18}$) acids with an alkali-metal hydroxide or carbonate.

The fatty alcohol sulfates useful in the practice of the present invention are alkyl sulfates wherein the alkyl group may be straight or branched, saturated or unsaturated, and have 6 to 24 carbon atoms, preferably about twelve to about eighteen carbon atoms. A preferred tauride is sodium N-dodecanoyl-N-methyl taurine.

The term "predominant," as used in connection with the proportion of acyl isethionate, means that the proportion of acyl isethionate is not exceeded by any other surface-active agent in the composition.

The linoleic dimer acid anti-mushing agent of the instant invention is described as to its constitution in U.S. Pat. No. 3,538,009, which is incorporated herein by reference. In that patent the dimer is disclosed as an additive to reduce skin irritation by detergents, and is described by the graphic formula

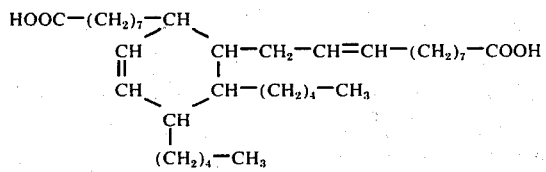

A method for preparing the dimer is disclosed in U.S. Pat. Nos. 2,482,761, 2,763,612, and 3,267,038.

The sodium chloride and sodium sulfate employed in the compositions of the invention are the well-known salts. The latter may be employed as the hepta- or decahydrate as well as the anhydrous salt. However, the proportions and ratios relating to sodium sulfate are illustrated herein in terms of the anhydrous salt.

All percentages and proportions are on the whole composition basis unless otherwise stated.

The invention may be more thoroughly understood by reference to the following Examples, which are to be considered illustrative, but not limitative, of the invention.

EXAMPLE 1

5750 pounds of sodium acyl isethionate having 75 percent active detergent matter are prepared in the following manner:

2965 lbs. of coconut fatty acids and 833 lbs. of fatty acids recovered in the stripping step of a previously prepared batch of fatty acid isethionate are combined in a scale tank. A slurry containing approximately 75 percent by weight of sodium isethionate, the slurry containing 2027 lbs. of sodium isethionate on a 100 percent pure basis are charged into a stock tank. Finally, 8 lbs. of zinc oxide are prepared as an aqueous slurry in another tank.

All of the foregoing ingredients are charged into a reactor and heated therein to a temperature of about 450°F by circulating the contents of the reactor through a heat exchanger via a pump.

When the temperature of the reaction mixture reaches about 380°–400°F, water evolved by the reaction together with steam distilled fatty acids begin to distill from the reactor. These vapors are condensed in a condenser. The fatty acids and water condensate are collected in a separator in which separator the fatty acids are decanted via a pipe and accumulated in a collecting tank.

The reaction is essentially complete in approximately 150 minutes at 450°–460°F, and both fatty acids and water cease to accumulate in the separator.

At this point, the reaction mixture is drained into a stripper which is also purged with nitrogen to maintain an oxygen-free atmosphere. By circulating a heat transfer liquid through the jacket of the stripper, the temperature of the reaction mixture is maintained between about 430° and 460°F.

A vacuum is applied by means of ejectors to obtain a vacuum of about 20 inches of mercury. After maintaining this vacuum for a period of about 15 minutes, 963 lbs. of molten stearic acid is charged into the stripper to maintain the fluidity of the reaction product therein after the initial portion of unreacted fatty acids is removed. The removal of the unreacted fatty acids of the charged stock is completed by further increasing the vacuum to about 27½ inches of mercury and maintaining it at this level, while the mass in the stripper is maintained at 450°F for a period of about 45 minutes. At this point, the pressure is brought back to atmospheric by shutting off the vacuum ejectors and introducing nitrogen into the stripper.

The fatty acids collected during the stripping are returned to the fatty acid charged tank for reuse in subsequent reactions.

After analyzing the completed batch of acyl isethionate, the reaction product, weighing 5750 lbs. is discharged and cooled. The analysis shows that the acyl isethionate content is about 75.0 percent, corresponding to a yield of about 92 percent based on the isethionate charged to the reactor.

EXAMPLE 2

This example illustrates the effectiveness as an anti-mush agent of linoleic acid dimer, as manifested by a decreased wear rate of the bar containing the dimer as compared to the wear rate of a control bar.

Bars are prepared having the following compositions:

| | Percent by Weight With Linoleic Acid Dimer | Control |
|---|---|---|
| Sodium acyl isethionate (active basis)[a] | 47.32 | 49.87 |
| Stearic acid | 19.19 | 20.20 |
| Coconut oil fatty acid | 2.93 | 3.08 |
| Soap of mixed tallow and coconut oil[b] | 7.92 | 8.33 |
| Sodium stearate | 2.84 | 2.99 |

-continued

| | Percent by Weight With Linoleic Acid Dimer | Control |
|---|---|---|
| Sodium isethionate | 4.54 | 4.79 |
| Sodium alkylbenzenesulfonate[c] | 1.92 | 2.02 |
| Sodium chloride | 0.35 | 0.35 |
| Linoleic acid dimer[d] | 5.00 | none |
| Water | 5.02 | 5.30 |
| $TiO_2$ | 0.20 | 0.20 |
| Perfume | 0.80 | 0.80 |
| Miscellaneous[e] | 1.97 | 2.07 |
| | 100.00 | 100.00 |

[a]prepared as in Example 1.
[b]sodium soap from a blend of 80% tallow and 20% coconut oil.
[c]sodium salt alkyl group in a straight chain having about 11 to about 15 carbon atoms and the sulfonated phenyl group is randomly positioned along the alkyl chain.
[d]Empol 1022, a trademark of Emery Industries.
[e]Inert matter unavoidably added in association with the components.

Bars subjected to the Wear-Rate Test described elsewhere herein lose 2.57 grams per use, whereas the control bars lose 2.93 grams per use (average). Thus the bars containing 5 percent of dimerized linoleic acid lose only 87.7 percent of the weight lost by the control bars per use.

EXAMPLE 3

This example illustrates the effectiveness of a mixture of sodium chloride and sodium sulfate in controlling wear rate without efflorescence.

Toilet detergent bars containing 5 percent sodium sulfate together with 5 percent sodium chloride are prepared and tested for wear rate, in comparison with a control. The compositions of the bars are as follows:

| | Percent by Weight With Linoleic Acid Dimer | Control |
|---|---|---|
| Sodium acyl isethionate (active basis) | 44.51 | 49.34 |
| Stearic acid | 18.04 | 19.99 |
| Coconut oil fatty acids | 2.75 | 3.05 |
| Soap of mixed tallow and coconut oil | 7.44 | 8.25 |
| Sodium stearate | 2.67 | 2.96 |
| Sodium isethionate | 4.28 | 4.74 |
| Sodium alkylbenzenesulfonate | 1.80 | 2.00 |
| Germicide | 0.90 | 1.00 |
| Sodium sulfate | 5.00 | none |
| Sodium chloride | 5.00 | 0.35 |
| Water | 4.74 | 5.25 |
| $TiO_2$ | 0.20 | 0.20 |
| Perfume | 0.82 | 0.82 |
| Miscellaneous | 1.85 | 2.05 |
| | 100.00 | 100.00 |

The ingredients are defined as in Example 2.

When subjected to the Wear-Rate Test the bars containing 5 percent sodium sulfate and 5 percent sodium chloride lose 3.03 grams per use, whereas the control bars lose 3.45 grams per use. The bars thus lose only 87.8 percent of the weight lost by the control bars. The bars do not effloresce when stored 6 weeks at 80°F and 80 percent relative humidity.

EXAMPLE 4

A second lot of bars is prepared with 5 percent $Na_2SO_4$ and 5 percent NaCl. The composition, along with that of a control, is as follows:

| | Percent by Weight With $Na_2SO_4$ and NaCl | Control |
|---|---|---|
| Sodium acyl isethionate (active basis) | 44.51 | 49.34 |
| Stearic acid | 18.04 | 19.99 |
| Coconut oil fatty acids | 2.75 | 3.05 |
| Soap of mixed tallow and coconut oil | 7.44 | 8.25 |
| Sodium stearate | 2.67 | 2.96 |
| Sodium isethionate | 4.28 | 4.74 |
| Sodium alkylbenzenesulfonate | 1.80 | 2.00 |
| Germicide | 0.90 | 1.00 |
| Sodium sulfate | 5.00 | none |
| Sodium chloride | 5.00 | 0.35 |
| Water | 4.74 | 5.25 |
| $TiO_2$ | 0.20 | 0.20 |
| Perfume | 0.82 | 0.82 |
| Miscellaneous | 1.85 | 2.05 |
| | 100.00 | 100.00 |

The ingredients are defined as in Example 2.

When subjected to the Wear-Rate test, the bars containing 5 percent $Na_2SO_4$ and 5 percent NaCl lose 2.63 grams per use, as compared with a loss of 3.17 grams per use by the control.

Bars having 7.5 percent each of $Na_2SO_4$ and NaCl lose 2.70 grams per use.

Comparatively the bars containing 5 percent each of $Na_2SO_4$ and NaCl lose only 83 percent, and the bars containing 7.5 percent each of $Na_2SO_4$ and NaCl lose only 85 percent, of the weight lost by the control.

EXAMPLE 5

The following compositions are within the scope of the invention.

| Composition No. | 1 | 2 | 3 | 4 | 5 | 6 | 7 |
|---|---|---|---|---|---|---|---|
| Sodium acyl isethionate | 40 | 50 | 60 | 50 | 55 | 60 | 40 |
| Fatty acid | 21 | 15 | 15 | 18 | 14 | 15 | 19 |
| Soap of a higher fatty acid | 11 | 10 | 9 | 7 | 9 | 5 | 9 |
| Sodium isethionate | 2 | 1.5 | 1.5 | 2.5 | 1.5 | 2 | 2 |
| Sodium alkylbenzene-sulfonate | 3 | 2 | 2 | 2 | 2 | 3 | 2 |
| Sodium sulfate | 7.5 | 5 | — | — | 4 | 2.5 | 10 |
| Sodium chloride | 5 | 7.5 | — | — | 3 | 2.5 | 10 |
| Linoleic acid dimer | — | — | 3 | 10 | 3 | — | — |
| Water | 6 | 4 | 3 | 4 | 5 | 4 | 4 |
| $TiO_2$ | 0.2 | 0.2 | 0.2 | 0.2 | 0.2 | 0.2 | 0.2 |
| Colorant (0.1% aqueous solution) | 0.1 | 0.1 | 0.1 | 0.1 | 0.1 | 0.1 | 0.1 |
| Perfume | 1 | 1 | 1 | 1 | 1 | 1 | 1 |
| Miscellaneous | 3.2 | 3.7 | 5.2 | 5.2 | 2.2 | 4.7 | 2.7 |
| | 100.0 | 100.0 | 100.0 | 100.0 | 100.0 | 100.0 | 100.0 |

The ingredients are defined as in Example 2.

EXAMPLE 6

The tablets of Example 3, into which a green colorant is incorporated, are subjected to the Firmness Recovery Test described herein above. As the tablets dry, they are weighed at elapsed times indicated below. The results, expressed in terms of percentage of absorbed water remaining, are shown in Table I.

TABLE I

| Drying time minutes | Percent Absorbed Water Remaining | | | | | | | | |
|---|---|---|---|---|---|---|---|---|---|
| | 5 | 15 | 25 | 45 | 65 | 105 | 135 | 165 | 19 hours |
| Control - no anti-mush agent | 72.3 | 64.6 | 63.1 | 55.4 | 55.4 | 50.8 | 46.2 | 44.6 | 21.5 |
| With 5% $Na_2SO_4$ | 70.3 | 59.4 | 57.8 | 48.4 | 46.9 | 42.2 | 34.4 | 35.9 | 7.8 |
| With 5% $Na_2SO_4$ + 5% NaCl | 69.8 | 53.5 | 51.2 | 44.2 | 44.2 | 37.2 | 32.6 | 32.6 | 9.3 |
| Sodium soap (80 tallow-20 CNO) | 79.8 | 62.6 | 48.0 | 27.3 | 15.2 | 7.6 | 4.5 | 4.0 | −5.0 |

The foregoing data show that tablets within the invention, e.g. those containing 5 percent $Na_2SO_4$ combined with 5 percent NaCl, lose water of hydration absorbed by contact therewith faster than do tablets having no anti-mush agent, or tablets which contain only 5 percent $Na_2SO_4$.

A soap tablet is shown to lose water of hydration under the above-described conditions much more rapidly than do nonsoap tablets, including tablets within the instant invention. After an extended drying period, in this case 19 hours, the tablets within the invention, and those containing 5 percent $Na_2SO_4$ without added NaCl, approach the initial tablet weight as determined immediately before immersion, more closely than the control without added salts, but still do not reach the stage of complete return to initial weight.

Visual observations made on the above-described tablets show the superiority of the tablet of the present invention as seen by the consumer. The superiority lies in more rapid recovery of firmness between usings of the tablet, resulting in a longer lasting bar. Immediately upon removal from the water, the half of the bar that is submerged is white and soft. After drying for one hour, a time estimated as reasonable for recovery after using, the soap bar is essentially dry appearing and hard, the green color reappearing. The control without added salts remains wet and mushy to the touch after one hour's drying, and is still white. The tablets of the invention are less mushy than are the control tablets, and lose some of their whiteness, after 1 hour. Visual differences between the tablets of the invention and those containing $Na_2So_4$ but no NaCl are difficult to distinguish, but the advantages of the former are clearly shown in the weight data in Table 1.

Tablets of the present invention have utility with respect to the amount of water picked up in the hydration step of the above-described Firmness Recovery Test. Tablets containing 5 percent each of sodium sulfate and sodium chloride absorb less water than do a control with no added salts, a tablet with 5 percent, $Na_2SO_4$ but no NaCl, or a soap tablet, as may be seen in the following table.

TABLE II

| | Weight of Tablet Before Immersion-grams | Percent of Water Absorbed during 5-Minute Immersion |
|---|---|---|
| Control | 105.23 | 0.65 |
| With 5% $Na_2SO_4$ | 111.77 | 0.64 |
| With 5% $Na_2SO_4$ + 5% NaCl | 111.42 | 0.43 |
| Sodium Soap (80 Tallow-20 CNO) | 87.20 | 1.98 |

Having described the invention, modifications and variations within the purview thereof will be evident to those skilled in the art, and the invention is to be limited only within the scope of the appended claims.

What is claimed is:

1. A toilet detergent tablet comprising from about 30 to about 60 percent of water-soluble alkali metal detergent salts of esters of isethionic acid with mixed aliphatic fatty acids having from 6 to 18 carbon atoms and an iodine value of less than 20, of which mixed acids at least 75 percent have from twelve to eighteen carbon atoms and up to 25 percent have from 6 to 10 carbon atoms, from 2 to 10 percent of at least one water-soluble suds-boosting detergent salt selected from the group consisting of alkali metal and organic amine higher aliphatic fatty alcohol sulfates, alkyl aryl sulfonates, and the higher aliphatic fatty acid taurides, from about 1 to about 9 percent water, from about 2.5 to about 25 percent of water-soluble higher fatty acid soap, from 10 to 40 percent of at least one higher fatty acid having from about 25 carbon atoms as a binder and plasticizer, and an anti-mushing agent in the proportions of about 3 to about 25 percent, wherein said anti-mushing agent is (a) linoleic acid dimer or (b) linoleic acid dimer together with a mixture of sodium sulfate and sodium chloride, said tablet having improved hardness, improved firmness recovery characteristics, and being substantially free from efflorescence, and having a pH within the range of about 6 to about 8, measured as a 10 percent aqueous solution of the bar composition at 35°C.

2. A toilet detergent in accordance with claim 1 wherein said anti-mushing agent is linoleic acid dimer in the proportions of about 3 to about 10 percent, by weight of said tablet.

3. A toilet detergent tablet in accordance with claim 1 wherein said anti-mushing agent is a mixture of sodium sulfate in the proportion of about 4 percent, sodium chloride in the proportion of about 3 percent, and linoleic acid dimer in the proportion of about 3 percent, said proportions being by weight of said tablet.

4. A process for lessening the mushing tendencies of a toilet detergent tablet containing an acyl isethionate in a proportion not exceeded by any other component therein, and in the proportions of about 30 to about 60 percent, comprising incorporating into said tablet from about 3 to about 20 percent of an anti-mushing agent selected from the group consisting of linoleic dimer acid, and linoleic acid dimer mixed with sodium sulfate and sodium chloride, the salts being present within the ratios of about 3:2 to about 2:3, said tablet having improved hardness, improved firmness recovery characteristics, and being substantially free from efflorescence, and having a pH within the range of about 6 to about 8, measured as a 10 percent aqueous solution of the bar composition at 35°C.

5. A toilet detergent tablet comprising

| | Parts by Weight of Bar |
|---|---|
| a. Sodium acyl isethionate | 40–60 |
| b. Fatty acid | 15–25 |
| c. Soap of a higher fatty acid | 5–15 |
| d. Sodium isethionate | 2–5 |
| e. Sodium alkylbenzenesulfonate | 2–4 |
| f. Linoleic acid dimer | 3–10 |
| g. Water | 3–6 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22 percent has 8–14 carbon atoms, and the alkyl group of said alkylbenzenesulfonate is derived from a straight-chain hydrocarbon mixture having an average of about 13 carbon atoms.

6. A toilet detergent tablet comprising

| | Parts By Weight of Bar |
|---|---|
| a. Sodium acyl isethionate | 40–60 |
| b. Fatty acid | 15–25 |
| c. Soap of a higher fatty acid | 5–15 |
| d. Sodium isethionate | 2–5 |
| e. Sodium alkylbenzenesulfonate | 2–4 |
| f. Sodium chloride | 3 |
| g. Sodium sulfate | 4 |
| h. Water | 3–6 |
| i. Linoleic acid dimer | 3 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22 percent has 8–14 carbon atoms, and the alkyl group of said alkylbenzenesulfonate is derived from a straight-chain hydrocarbon mixture having an average of about 13 carbon atoms.

* * * * *